United States Patent [19]

Rhodes, Jr.

[11] Patent Number: 4,696,328

[45] Date of Patent: Sep. 29, 1987

[54] SPILLAGE PREVENTION

[76] Inventor: Harold B. Rhodes, Jr., 1805 Wilton Rd., Leucadia, Calif. 92024

[21] Appl. No.: 895,123

[22] Filed: Aug. 11, 1986

[51] Int. Cl.[4] ..... B65D 47/10

[52] U.S. Cl. ..... 141/1; 184/1.5; 222/541

[58] Field of Search ..... 141/1, 114, 311 R, 363, 141/364, 366; 184/1.5; 215/250, 253; 220/258; 222/107, 213, 491, 541; 285/3, 4; 383/906

[56] References Cited

U.S. PATENT DOCUMENTS

| | | | |
|---|---|---|---|
| 1,359,651 | 11/1920 | Andrews | 220/266 |
| 1,409,544 | 3/1922 | Hallock | 222/107 X |
| 3,118,573 | 1/1964 | Johnson | 222/212 |
| 3,229,635 | 1/1966 | Oss | 220/266 X |
| 3,595,446 | 7/1971 | Hellstrom | 222/213 |
| 3,601,252 | 8/1971 | Sager | 206/56 AA |
| 3,934,623 | 1/1976 | Hays | 141/364 X |
| 4,105,133 | 8/1978 | La Barge et al. | 220/266 |
| 4,219,126 | 8/1980 | Oana | 220/89 A |
| 4,598,839 | 7/1986 | Dombroski et al. | 222/541 X |

*Primary Examiner*—Henry J. Recla

*Assistant Examiner*—Mark J. Thronson

*Attorney, Agent, or Firm*—Edward W. Callan

[57] ABSTRACT

A bottle that can be used for preventing spillage when the bottle is tilted for positioning the bottle so that all of the liquid therein is received by an intended receptacle for the liquid. The bottle is made of a flexible material that may be squeezed to decrease the interior volume of the bottle, and has an elongated neck terminating in an opening that is wide enough to enable viscous liquid to pour freely therethrough from the bottle when the bottle is tilted. An airtight seal is secured to the perimeter of the neck and closes the opening for preventing liquid from being poured from the opening when the bottle is tilted; and the seal is rupturable upon pressure being exerted thereon by the contents of the bottle when the container is squeezed. In order to prevent the seal from being ruptured during handling of the bottle prior to such time as it is desired to pour the liquid from the bottle, a cap is fitted over the opening of the bottle and contacts the seal to counteract any pressure applied against the seal as a result of the squeezing the bottle and thereby prevents the seal from being ruptured.

2 Claims, 5 Drawing Figures

SPILLAGE PREVENTION

BACKGROUND OF THE INVENTION

The present invention generally pertains to bottles and is particularly directed to preventing spillage when pouring liquid from a bottle.

There has been a long enduring problem of being able to pour liquids, particularly viscous liquids, from a bottle without spilling some of the liquid outside of the intended receptacle for the liquid. This problem is particularly prevalent when it comes to pouring motor oil from a bottle into the crankcase of an automobile; and as a result one must resort to use of a funnel to direct the oil poured from the bottle into the opening of the crankcase intended for the receipt of the oil without spilling the oil on the engine block. Although motor oil now is packaged in plastic bottles with elongated necks, spillage nevertheless frequently occurs when the bottle is tilted into position for pouring the oil into the opening of the crankcase in the engine block without the accompanying use of a funnel. Since funnels are not always available, and in any event become coated with the messy oil, it is desired to provide a container, system and method for preventing spillage when pouring a liquid from a bottle independent of the use of a funnel.

SUMMARY OF THE INVENTION

The present invention provides a bottle that can be used in a system and method according to the present invention for preventing spillage when the bottle is tilted for positioning the bottle so that all of the liquid therein is received by an intended receptacle for the liquid.

The liquid containing bottle is made of a flexible material that may be squeezed to decrease the interior volume of the bottle, and has an elongated neck terminating in an opening that is wide enough to enable viscous liquid to pour freely therethrough from the bottle when the bottle is tilted. An airtight seal is secured to the perimeter of the neck and closes the opening for preventing liquid from being poured from the opening when the bottle is tilted; and the seal is rupturable upon pressure being exerted thereon by the contents of the bottle when the bottle is squeezed. In order to prevent the seal from being ruptured during handling of the bottle prior to such time as it is desired to pour the liquid from the bottle, a cap is fitted over the opening of the bottle and to counteract any pressure applied against the seal as a result of the squeezing the bottle and thereby prevents the seal from being ruptured.

The present invention further provides a method of pouring liquid into a machine through an opening in the machine without spilling the liquid outside of the opening in the machine. Such method includes the steps of (a) providing the liquid in a bottle made of a flexible material that may be squeezed to decrease the interior volume of the bottle, and having an elongated neck terminating in an opening that is wide enough to enable viscous liquid to pour freely therethrough from the bottle when the bottle is tilted, said bottle including an airtight seal secured to the perimeter of the neck and closing the opening for preventing liquid from being poured from the opening when the bottle is tilted, wherein the seal is rupturable upon pressure being exerted thereon by the contents of the bottle when the bottle is squeezed; (b) tilting the bottle and inserting the neck of the tilted bottle into the opening of the machine; and (c) squeezing the tilted bottle to rupture the seal to cause the liquid to pour from the bottle and into the machine without spilling the liquid outside of the opening of the machine.

The spillage prevention system of the present invention implements the method of the present invention and is described in relation to the description of the preferred embodiment.

DESCRIPTION OF THE PREFERRED EMBODIMENT

Figure 1:
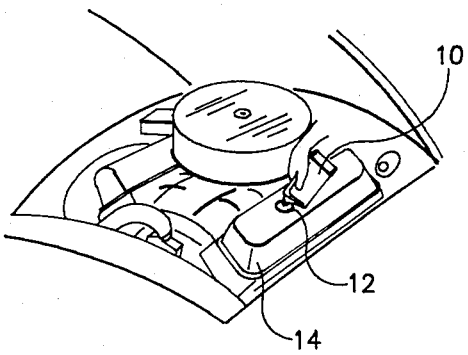
FIG. 1 illustrates the use of a bottle according to the present invention in the method and system of the present invention.

Referring to FIG. 1, a bottle 10 according to the present invention is used to pour oil into an opening 12 in an automobile engine block 14 in a preferred embodiment of the method and system of the present invention.

Figure 2:
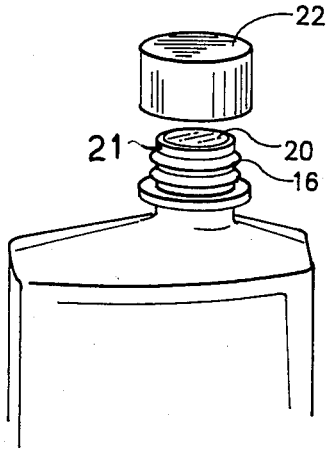
FIG. 2 is a partial perspective view of a preferred embodiment of a bottle according to the present invention.
Figure 3:
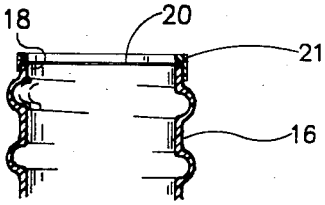
FIG. 3 is a vertical axial sectional view of the neck of the bottle of FIG. 2.

Referring to FIGS. 2 and 3, the bottle 10 is made of a flexible plastic material that may be squeezed to decrease the interior volume of the bottle. The bottle 10 has an elongated neck 16 that terminates in an opening 18 that is wide enough to enable a viscous liquid, such as motor oil, to pour freely therethrough from the bottle 10 when the bottle is tilted, as shown in FIG. 1. Such a bottle presently is in use as a motor oil container. The bottle 10 of the present invention further contains an airtight seal 20, preferably made of a thin plastic material, that is secured to the perimeter of the neck 16 of the bottle 10 and closes the opening 18 of the bottle to prevent the liquid from being poured from the bottle 10 when the bottle is tilted. The seal 20 is rupturable upon pressure being exerted thereon by the contents of the bottle 10 when the bottle is squeezed. The seal 20 is secured to the neck 16 of the bottle 10 by a clamp 21.

Figure 4:
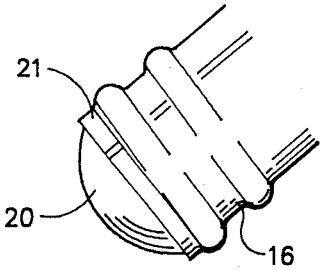
FIG. 4 illustrates the seal of the bottle expanding prior to rupturing as a result of the bottle of FIG. 2 being squeezed.

A cap 22 is fitted over the opening 18 of the bottle 10 and contacts the seal 20 to counteract any pressure applied against the seal 20 as a result of squeezing the bottle 10 to prevent the seal 20 from being ruptured inadvertently while the bottle 10 is being handled before such time as it is desired to pour the liquid from the bottle. The cap 22 need not intimately contact the seal 20 at all times, provided that it is positioned sufficiently close to the seal 20 that when the seal 20 expands outward upon the bottle 10 being squeezed, as illustrated in FIG. 4 (without the cap being present), the seal 20 contacts the cap 22 prior to the seal 20 expanding to the extent that it ruptures.

When it is desired to pour the motor oil into the crankcase of the automobile engine, the cap 22 is removed from the bottle 10.

The bottle 10 is then tilted and the neck 16 of the bottle 10 is inserted into the opening 12 in the engine block 14.

Figure 5:
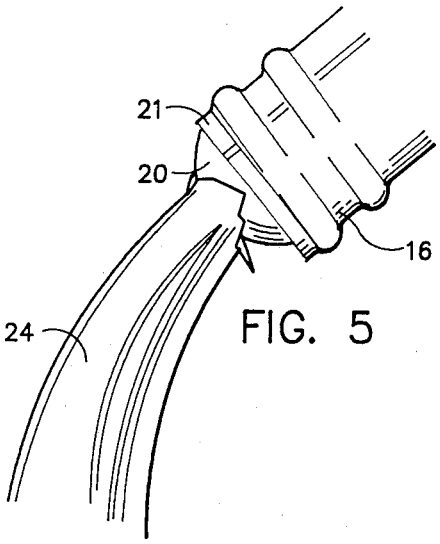
FIG. 5 illustrates liquid freely pouring from the open neck of the bottle of FIG. 2 after the seal has been ruptured.

The tilted bottle 10 is then squeezed, as shown in FIG. 1. The pressure exerted by squeezing the bottle 10 forces the oil in the bottle to exert pressure against the seal 20 and forces the seal 20 outward, as shown in FIG. 4. Finally the force exerted on the seal 20 by squeezing the bottle 10 ruptures the seal 20, as shown in FIG. 5, and allows the oil 24 to flow from the bottle 10 and into the crankcase without spilling the oil outside of the opening 12 in the engine block 14.

The present invention is applicable to bottles other than motor oil bottles and can be used for preventing spillage in pouring many types of liquids, including nonviscous liquids, into machines other than automobile engines.

I claim:

1. A method of pouring liquid into a machine through an opening in the machine without spilling the liquid outside of the opening in the machine, comprising the steps of (a) providing the liquid in a bottle made of a flexible material that may be squeezed to decrease the interior volume of the bottle, and having an elongated neck terminating in an opening that is wide enough to enable viscous liquid to pour freely therethrough from the bottle when the bottle is tilted, said bottle including an airtight seal secured to the perimeter of the neck and closing the opening for preventing liquid from being poured from the opening when the bottle is tilted, wherein the seal is rupturable upon pressure being exerted thereon by the contents of the bottle when the bottle is squeezed;

(b) tilting the bottle and inserting the neck of the tilted bottle into the opening of the machine; and (c) rupturing the seal by squeezing the tilted bottle and thereafter pouring the liquid from the tilted bottle by gravity and into the machine without spilling the liquid outside of the opening of the machine.

2. A method according to claim 1, further comprising the steps of (d) prior to the time of pouring the liquid from the bottle, fitting a cap over the opening of the bottle to counteract any pressure applied against the seal as a result of squeezing the bottle to thereby prevent the seal from being ruptured; and (e) when it is desired to pour liquid from the bottle, removing the cap from the bottle, prior to inserting the neck of the bottle into the opening of the machine.

* * * * *